US006427997B1

(12) United States Patent
Hirota et al.

(10) Patent No.: US 6,427,997 B1
(45) Date of Patent: Aug. 6, 2002

(54) SHEET STACKER WITH ALIGNING/ CONVEYING ROLLERS AND IMAGE FORMING APPARATUS USING THE SAME

(75) Inventors: Kazuhiro Hirota; Hisao Hosoya; Masanobu Kawano, all of Hachioji; Yuji Kanazawa, Musashino; Mamoru Tomotsune, Asaka; Takanori Yoshida, Toda; Hideyo Ohashi, Miyoshi-machi; Yukihiko Nishimoto, Akiruno, all of (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/592,390

(22) Filed: Jun. 13, 2000

(30) Foreign Application Priority Data

Jun. 15, 1999 (JP) ..... 11-168306
Jul. 21, 1999 (JP) ..... 11-205516

(51) Int. Cl.[7] ..... B65H 31/34
(52) U.S. Cl. ..... 270/58.12; 399/410
(58) Field of Search ..... 270/58.11, 58.12, 270/58.14, 58.16; 271/221, 222, 233, 245; 399/410

(56) References Cited

U.S. PATENT DOCUMENTS 5,288,062 A * 2/1994 Rizzolo et al. ..... 270/58.12
5,398,918 A * 3/1995 Rizzolo et al. ..... 270/58.08
5,462,265 A * 10/1995 Mandel et al. ..... 270/58.09
5,509,645 A * 4/1996 Shinno et al. ..... 270/58.17
6,142,461 A 11/2000 Asao et al.

FOREIGN PATENT DOCUMENTS

EP 0 548 566 A2 6/1993
EP 0 850 866 A1 7/1998
JP 60-142359 7/1985
JP 60-158463 8/1985
JP 62-239169 10/1987
JP 62-288002 12/1987
JP 63-267667 11/1988
JP 2-276691 11/1990
JP 3-277591 12/1991
JP 5-41991 6/1993
JP 8-217323 8/1996
JP 8-319054 12/1996
JP 9-221259 A * 8/1997

OTHER PUBLICATIONS

Patent Abstracts of Japan, vol. 1995, No. 09, Oct. 31, 1995 and JP 07–157181 A (FUJI XEROX CO. LTD.) Jun. 20, 1995.

* cited by examiner

*Primary Examiner*—Christopher P. Ellis
*Assistant Examiner*—Patrick Mackey
(74) *Attorney, Agent, or Firm*—Frishauf, Holtz, Goodman & Chick, P.C.

(57) ABSTRACT

A sheet finishing apparatus is provided with a sheet passage; a conveyor to covey a sheet along the sheet passage; an intermediate stacker on which the sheet conveyed along the sheet passage is placed so that a bundle of sheets is formed on the intermediate stacker; a finisher to conduct a finishing process for the bundle of sheets formed on the intermediate stacker; a sheet delivering section to which the bundle of sheets is delivered; and a sheet delivering device to true up edges of the bundle of sheets on the intermediate stacker before the finisher conducts the finishing process and to deliver the bundle of sheets from the intermediate stacker to the sheet delivering section after the finisher has conducted the finishing process.

11 Claims, 15 Drawing Sheets

FIG. 6 ( a )
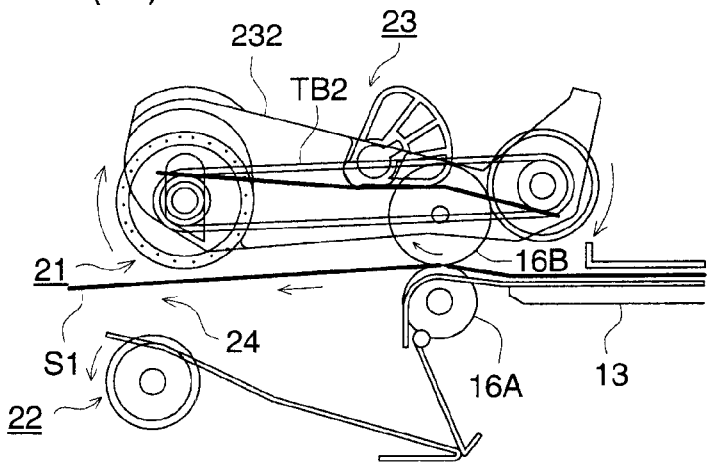
FIG. 6 ( b )
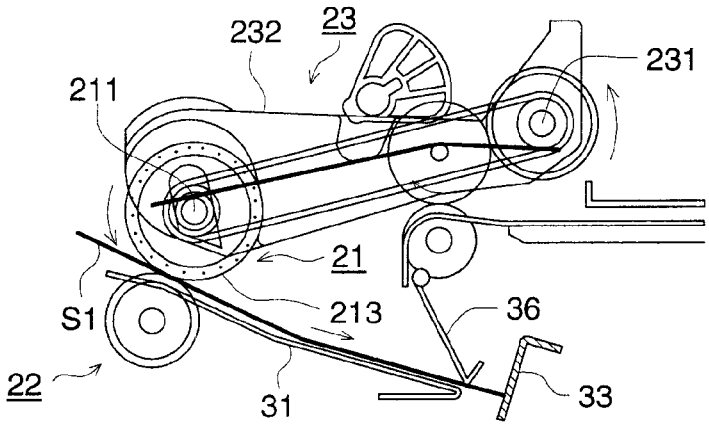
FIG. 6 ( c )
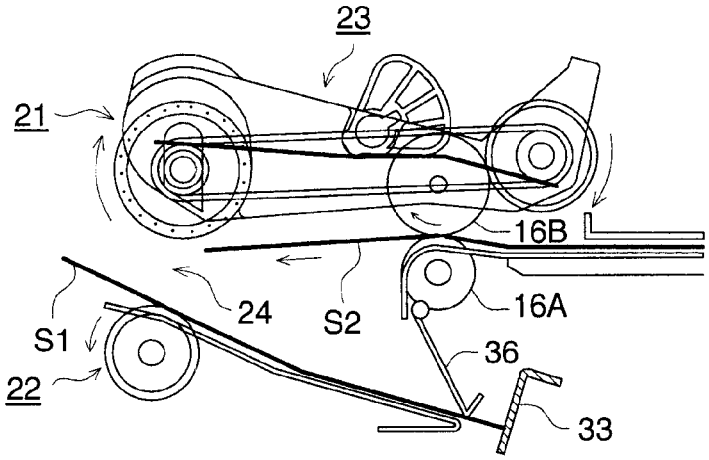

FIG. 6 ( d )
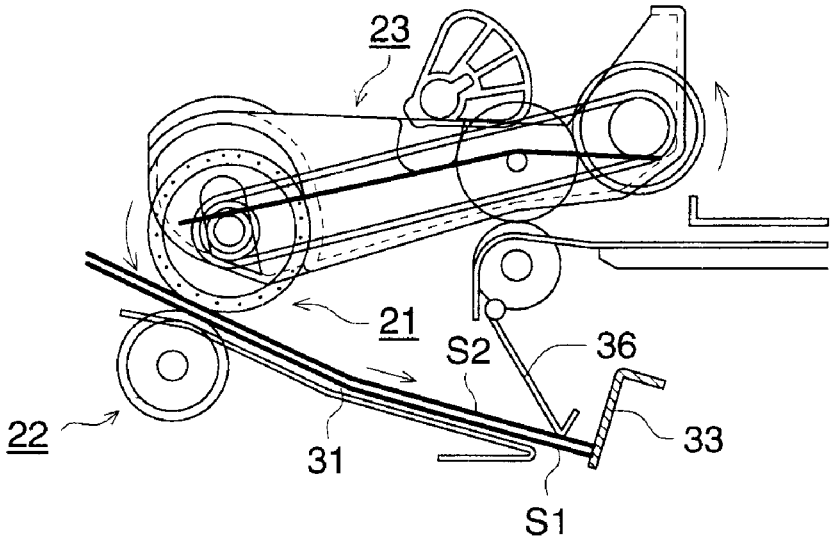
FIG. 6 ( e )
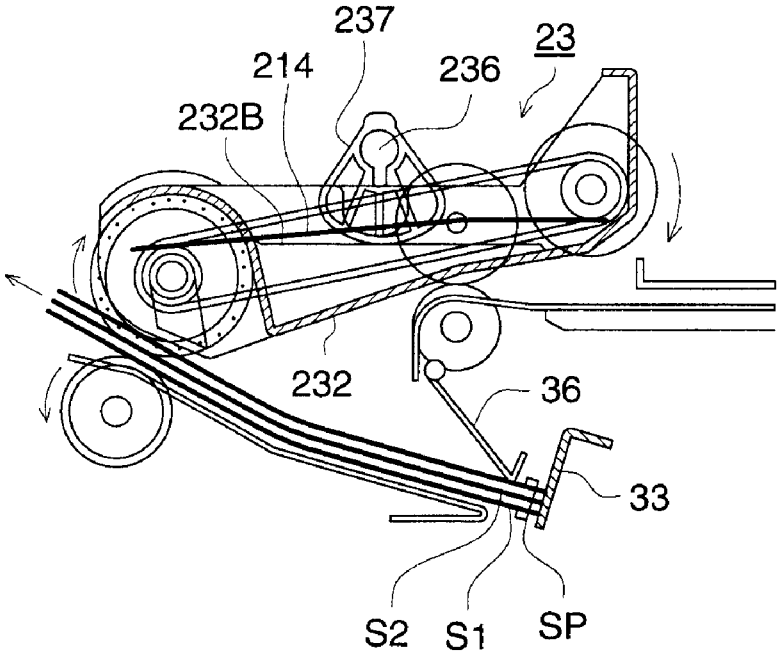

FIG. 7 ( a )
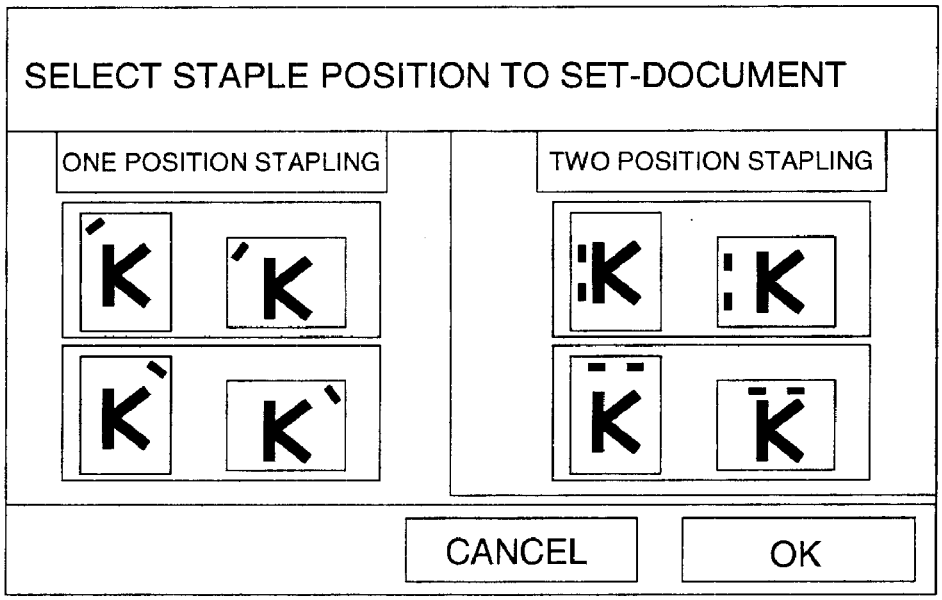
FIG. 7 ( b )
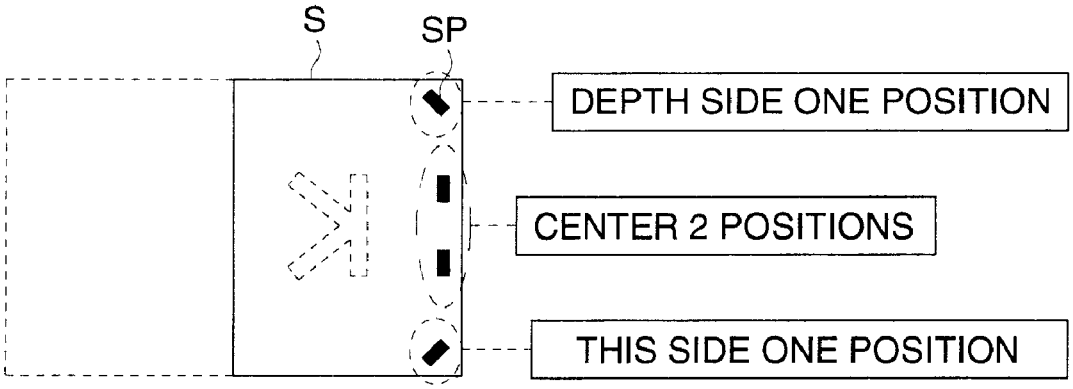

FIG. 9 ( a )
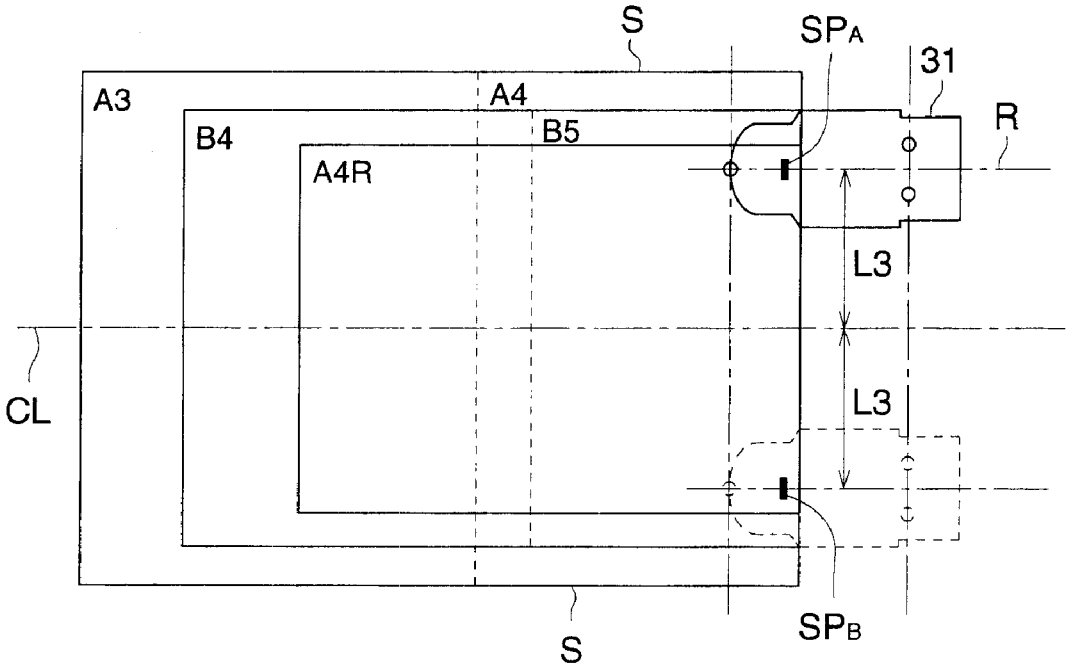
FIG. 9 ( b )
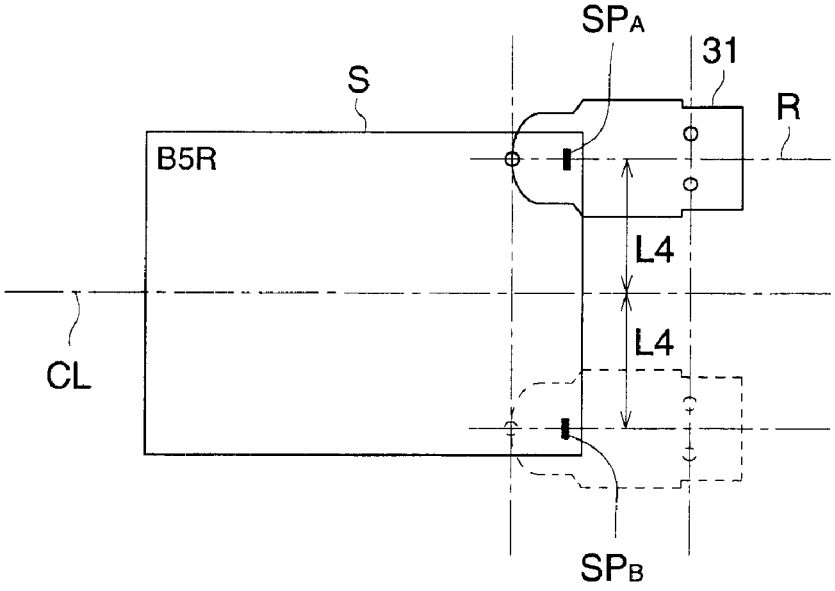

FIG. 13 ( a )
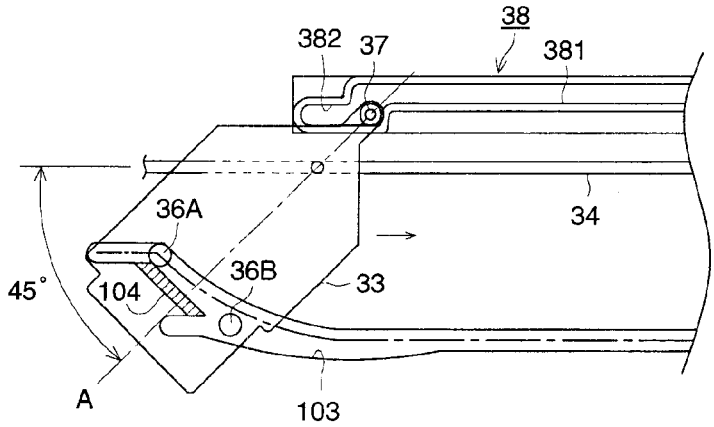
FIG. 13 ( b )
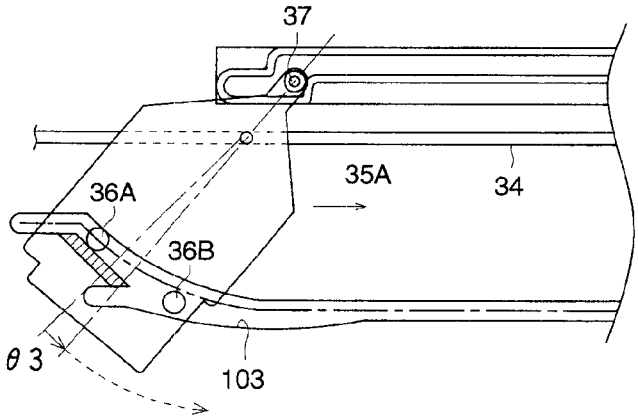
FIG. 13 ( c )
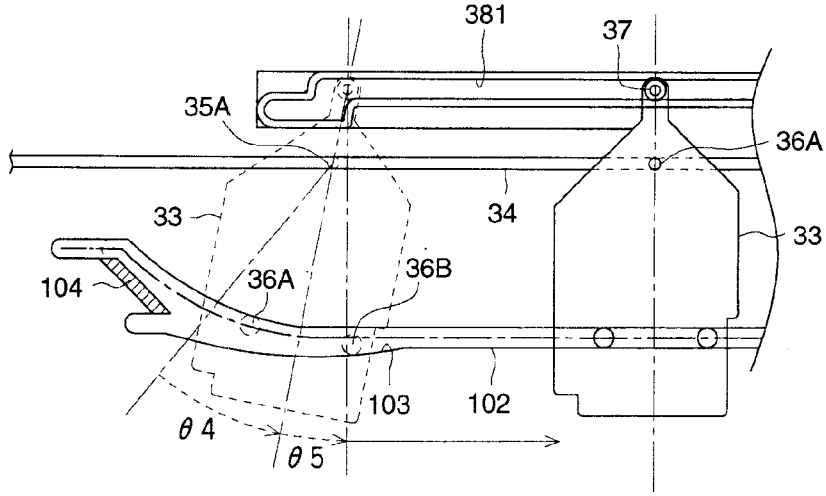

SHEET STACKER WITH ALIGNING/ CONVEYING ROLLERS AND IMAGE FORMING APPARATUS USING THE SAME

BACKGROUND OF THE INVENTION

The present invention relates to a sheet finishing apparatus by which image formed sheets delivered from an image forming apparatus main body are ejected by a sheet delivery means and are placed on a sheet delivery tray, and to an image forming apparatus.

A sheet finishing apparatus is used as an apparatus by which a plurality of image formed sheets delivered from the image forming apparatus main body are stacked as a bundle of sheets and stapled by a stapling means. Further, as the sheet finishing apparatus, there is an apparatus which has a function conduct various processes, such as a shift assorting process, an arrangement process, a punching process, a bookbinding process, or the like, except the stapling processing.

To the sheet finishing apparatus, the image forming apparatus such as a copier, printer, facsimile device, or the like, and the function are connected, and the sheet finishing apparatus is driven corresponding to the sequence operation of a copy or print process.

The sheet finishing apparatus conducts sheet finishing such as stapling processing, shift separation processing, or arrangement processing, onto the received sheets, and after that, the processed sheets are delivered onto the sheet delivery tray.

Incidentally, relating to the sheet finishing apparatus, the structure in which each kind of sheet is conveyed to a finishing processing section and brought into contact with a stopper means, is already disclosed in each of Japanese Tokkaisho No. 60-142359, 60-158463, 62-239169, 62-288002, 63-267667, Tokkaihei No. 2-276691, 8-319054, and Tokkohei No. 5-41991.

The image formed sheet conveyed into the sheet finishing apparatus is conveyed by a conveying means, and after that, reversely conveyed onto an intermediate stacker, and a trailing edge portion of the sheet is brought into contact with a stopper means, and stopped at a predetermined position. At this stop position, a plurality of sheets are successively conveyed and stacked, and the trailing edge portions are aligned. After the sheet finishing such as stapling is conducted on the bundle of sheets whose trailing edge portions are aligned, the bundle of sheets is delivered on the delivery sheet tray outside the apparatus by a sheet delivery means.

As the sheet delivery means of the sheet finishing apparatus, the following mechanisms are known.

(1) A sheet finishing apparatus in which the sheet is conveyed to the finishing section by a winding ring, and brought into contact with the stopper means, and only at the time of sheet delivery, the sheet delivery roller is lowered and the bundle of sheets is delivered.

(2) A sheet delivery means in which the intermediate stacker is arranged at a steep inclination angle, and the sheet is conveyed to the finishing section by the free dropping of the sheet, and is brought into contact with the stopper means, and the sheet delivery roller is operated up and down by using an engagement mechanism, and at the time of the delivery of the bundle of sheets, the bundle is delivered when the pressing force is applied onto the sheet delivery roller by using a solenoid.

(3) A sheet finishing apparatus in which a vertical force automatic changing apparatus is provided on the sheet delivery means, and the vertical force to obtain the higher holding force, is applied when the bundle of sheets in which a plurality of sheets are stapling processed, is delivered, rather than when one sheet is delivered. (Japanese Tokkaihei No. 8-217323).

Any sheet finishing apparatus of the above, is difficult to stabilize the sheet conveyance property for the sheets having every characteristics, and there is a possibility that the influence of the curl of the sheet or the static electricity is exerted. Further, there is also a problem that the mechanism is complicated and the production cost is increased.

The first object of the present invention is to improve the above problem in the conventional sheet finishing apparatus, and to provide a sheet finishing apparatus in which the sheet arrangement performance is increased, and a sheet delivery means having a simple structure is provided, and an image forming apparatus.

Incidentally, the image forming apparatus written in Japanese Tokkaihei No. 3-277591 is structured such that it has the first stapling mode in which one position of the end portion of the recording sheet is stapled, and the second stapling mode in which 2 positions in the vicinity of the center of the recording sheet are stapled, and respective positions at predetermined dimensions are arbitrarily inputted and set, and stapled, without depending on the size of the recording sheet.

In the conventional sheet finishing apparatus, when the first stapling processing in which one position is slantingly stapled at the end portion of the sheet, and the second stapling processing in which 2 position in the vicinity of the center of the recording sheet are stapled in parallel, can be selectively conducted for each kind of sheets of large or small sizes, the exclusive use driving means for respectively moving a pair of left and right staple means linearly and rotationally are necessary.

That is, the first driving means for linearly moving the pair of left and right staple means respectively in parallel to a predetermined position, and the second and the third driving means for respectively rotating the pair of left and right staple means by a predetermined angle in order to slantingly staple, are provided in the apparatus. Accordingly, in order to drive these driving means, at least 3 exclusive use driving motors and the control means for controlling these driving motors are necessary.

Accordingly, the number of component members of the driving motors, driving means, and control means is increased, the structure becomes complicated, and the assembling manhours are increased, and the production cost is increased.

Further, when a pair of left and right stapling means are arranged in parallel, and 2 positions in parallel are stapled, the minimum interval of the parallel stapling is limited by the dimension of the width of the staple means.

Further, in the conventional sheet finishing apparatus, because a plurality of driving motors and a plurality of driving means are necessary, the apparatus becomes complicated, and the production cost is increased.

Accordingly, the second object of the present invention is to provide a sheet finishing apparatus in which the assembling adjustment operation or maintenance operation can be easily and quickly conducted by the simplification of the staple processing component members of the sheet finishing apparatus, and a decrease of the production cost is attained.

SUMMARY OF THE INVENTION

In the sheet finishing apparatus to attain the first object, in which, after the image formed sheet is conveyed by a conveying means of the sheet finishing apparatus, the sheet is stacked on an intermediate stacker, and after the sheet is finished by the finishing means, the sheet is delivered by the sheet delivery means and stacked onto the sheet delivery tray, the sheet delivery means has: a sheet delivery roller composed of a sheet delivery upper roller and a sheet delivery lower roller by which the sheet can be nipped and conveyed and delivered, and which can be rotated positively and reversely; and a contact pressure means for oscillating the sheet delivery upper roller and enabling the roller to come into pressure-contact with the sheet delivery lower roller and to separate from it; and a driving means whose drive source is a driving motor which can be positively and reversely rotated, and which drive the sheet delivery upper roller and the sheet delivery lower roller, and the pressure contact means.

Further, the image forming apparatus to attain the first object is provided with the sheet finishing apparatus.

In the sheet finishing apparatus to attain the second object, in which, after the image formed sheet delivered from the image forming apparatus main body is conveyed and stacked and arranged on the intermediate stacker, 2 portions or one portion of the sheet are staple processed by the staple means, the apparatus is structured by: one staple means slantingly arranged in the conveyance direction of the sheet; the sheet finishing apparatus main body which movably supports the staple means on the inclined surface; and the driving means composed of one drive source which linearly moves the staple means in the direction perpendicular to the conveyance direction of the sheet and rotationally moves the staple means in the vicinity of the corner portion of the sheet, wherein the parallel staple processing to 2 portions of the sheet in parallel to the direction perpendicular to the conveyance direction of the sheet, and the slanting staple processing to one portion in the vicinity of the corner portion of the sheet, are conducted by the one slantingly arranged staple means.

BRIEF DESCRIPTION OF THE DRAWINGS

FIG. 6(*a*) to FIG. 6(*e*) are front views showing the sheet conveyance and sheet delivery process by the sheet delivery means.

FIG. 7(*a*) and FIG. 7(*b*) are a partial plan view showing an operation panel arranged on the front surface side of the image forming apparatus main body, and a plan view showing a position of staple pins for staple processing onto the sheet.

FIG. 9(*a*) and FIG. 9(*b*) are plan views showing a condition that the staple pins are stapled in parallel on two portions of each kind of sized sheets by one staple means.

FIGS. 13(*a*) to 13(*c*) are partial plan views showing a returning process in which the staple means transfers from the rotational movement to the linear movement, and returns to the initial position.

DETAILED DESCRIPTION OF THE PREFERRED EMBODIMENT

Next, referring to attached drawings, an embodiment of an image forming apparatus having a sheet finishing apparatus provided with a sheet delivery means of the present invention will be described.

Figure 1:
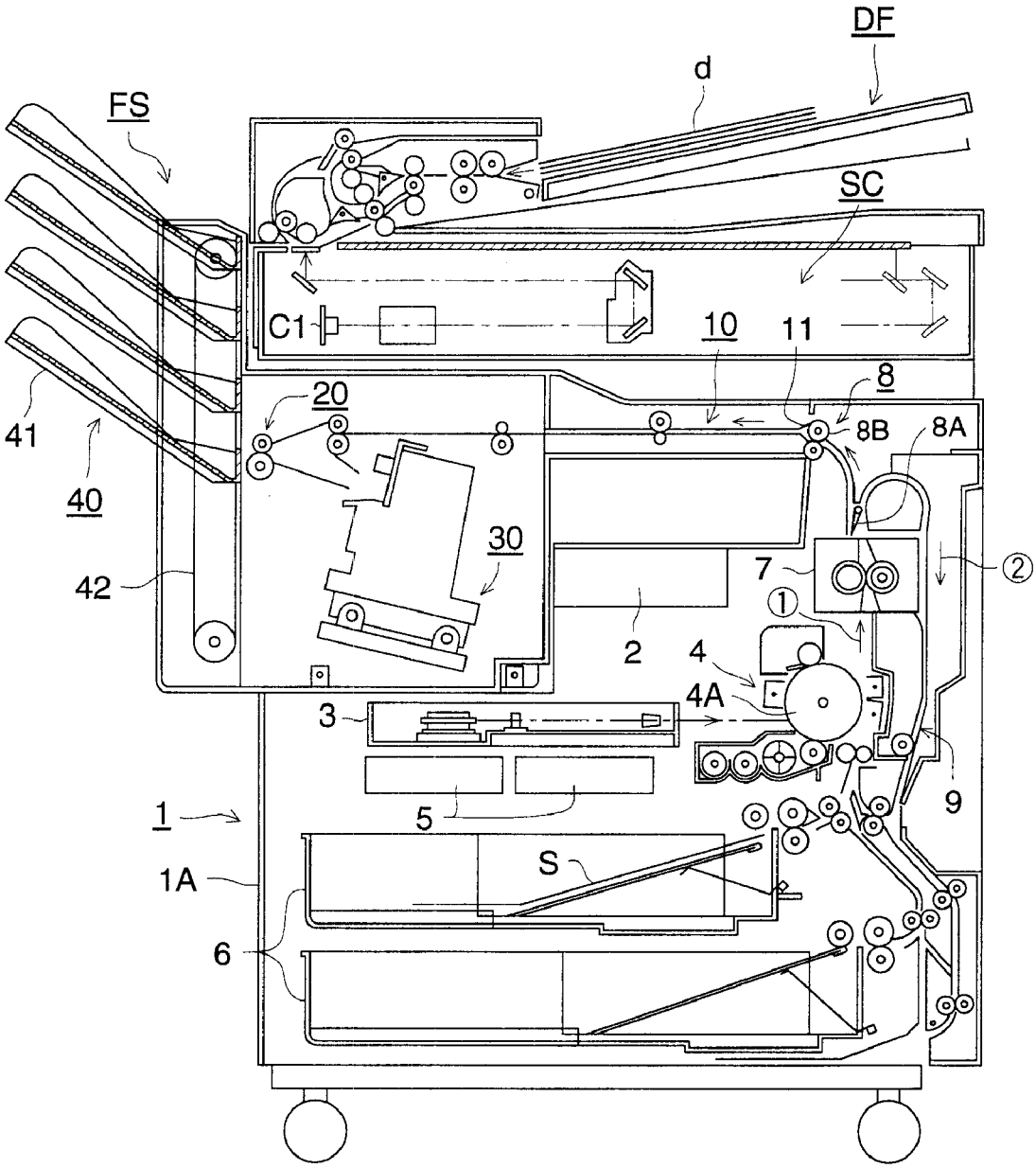
FIG. 1 is an overall structural view of an image forming apparatus equipped with a sheet finishing apparatus, automatic document feeding apparatus and image reading apparatus.

FIG. 1 is an overall structural view of an image forming apparatus 1 equipped with a sheet finishing apparatus FS, automatic document feeding apparatus DF, and image reading apparatus (scanner) SC.

An image forming apparatus main body 1A shown in the drawing, is provided with an image processing section 2, image writing section 3, image forming section 4, high voltage power source section 5, cassette sheet feed section 6, fixing apparatus 7, sheet delivery section 8, and automatic double-sided copy conveying section (ADU) 9.

The image reading apparatus SC and automatic document feeding apparatus DF are mounted on the upper portion of the image forming apparatus main body 1. The sheet finishing. apparatus FS is connected to the sheet delivery section 8 side of the left upper portion, shown in the drawing, of the image forming apparatus, main body 1A.

A document d placed on a platen of the automatic document feeding apparatus DF is conveyed in the arrowed direction, and one sided or double-sided images of the document are read by an optical system of the image reading apparatus SC, and read in a CCD image sensor C1.

An analog signal which is photo-electric converted by the CCD image sensor C1, is subjected to analog processing, A/D conversion, and image compression processing in the image processing section 2, and after that, the signal is sent to the image writing section 3.

In the image writing section 3, the output light from a semiconductor laser is irradiated onto a photoreceptor drum 4A, and a latent image is formed. In the image forming section 4, processing such as charging, exposing, developing, transferring, separation, and cleaning, is conducted, and an image is transferred onto a sheet S conveyed from a cassette sheet feed section 6. The sheet S on which the image is held, is fixed by a fixing apparatus 7, and sent from the sheet delivery section 8 into the sheet finishing apparatus FS. Alternatively, the sheet S on whose one side surface the image is processed, which is sent into the automatic double-side copy conveying section 9 by a conveyance path switch plate 8A, is double side image processed again in the image forming section 4, and after that, the sheet S is sent from the sheet delivery section 8 into the sheet finishing apparatus FS.

The sheet finishing apparatus FS is detachably mounted on the left upper section of the image forming apparatus main body 1A. The sheet finishing apparatus FS is composed of a sheet conveying means 10, sheet delivery means 20, sheet finishing means 30, and elevating sheet delivery means 40.

In FIG. 1, on a little to right side in the image forming apparatus main body 1A, around the image forming section 4, the cassette sheet feed section 6 is provided in the lower portion in the vertical direction, and the fixing apparatus 7 and sheet delivery section 8 are provided in the upper portion. According to this vertical arrangement structure, an almost vertical direction sheet conveyance path (1) is formed. The sheet S sent from the cassette sheet feed section 6, is conveyed along the sheet conveyance path (1) in the vertically upper portion, and is delivered outside the apparatus main body.

In almost parallel to the vertical direction sheet conveyance path (1), a sheet conveyance path (2) by the automatic double sided copy conveying section 9 is formed.

By forming the above vertical direction sheet conveyance paths (1) and (2), the shortest distance sheet conveyance path from the cassette sheet feed section 6 to the sheet delivery section 8 is formed.

The sheet conveying means 10 of the sheet finishing apparatus FS is housed in a upper space portion, shown in the drawing, of the image forming apparatus main body 1A. A sheet entry portion 11 of the sheet conveying means 10 is connected to a sheet delivery roller 8B of the sheet delivery section 8 of the image forming apparatus main body 1A. Further, in this mounted condition, the sheet delivery means 20 and the sheet finishing means 30 of the sheet finishing apparatus FS are housed in a left upper space portion, shown in the drawing, of the image forming apparatus main body. The elevating sheet delivery means 40 composed of a plurality of sheet delivery trays 41 and the elevation driving means 42 is positioned on the side surface side of the apparatus main body.

Figure 2:
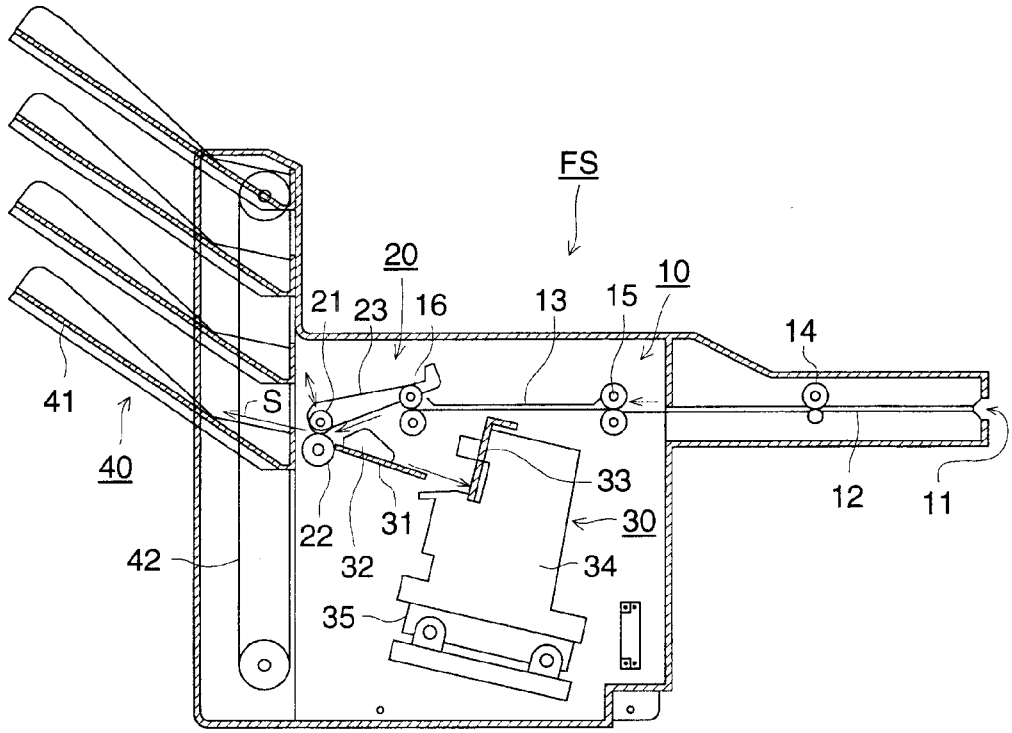
FIG. 2 is a sectional view of the sheet finishing apparatus.

The embodiment to attain the first object will be described below. FIG. 2 is a sectional view of the sheet finishing apparatus FS.

In FIG. 2, the sheet finishing apparatus FS is composed of the sheet conveying means 10, sheet delivery means 10, sheet finishing means 30, and elevating sheet delivery means 40, and is formed into a unit, and detachable to the apparatus main body, and by a moving means such as a guide rail, the sheet finishing apparatus can be drawn out to this side of the drawing.

The sheet conveying means 10 is connected to the sheet entry portion 11 opposite to a sheet delivery roller 8B of the sheet delivery section 8, and is structured by sheet conveyance guide plate (hereinafter, called guide plate) 12 and 13 to guide the delivered sheet S to the sheet delivery means 20, and conveying rollers 14, 15 and 16 composed of driving rollers and driven rollers which nip the sheet S and convey it. The sheet path composed of these guide plates 12, 13 and conveying rollers 14, 15 and 16, forms an almost horizontal conveyance path. Each of driving rollers of conveying rollers 14, 15 and 16 is positively rotated by a driving motor, not shown.

The sheet delivery means 20 is composed of a sheet delivery upper roller 21 which is connected to a driving source and rotated positively and reversely, and a sheet delivery lower roller 22, and a contact-pressure means 23. The sheet delivery upper roller 21 is moved up and down by a torque limiter and presses the sheet delivery lower roller 22 by the contact-pressure means 23.

The sheet finishing means 30 is structured by: an intermediate stacker 31 on which a plurality of sheets S conveyed by the sheet conveying means 10 are stacked; a width aligning means 32 for arranging and regulating the width direction of the sheets S stacked on the intermediate stacker 31; a stopper means 33 with which the leading edge of the advancing direction of the sheet S stacked on the intermediate stacker 31 is brought into contact, and by which the conveyance direction is positioned; a staple means (stapler) 34 for stapling the staple pins SP onto the bundle of sheets; and a moving means 35 for moving the staple means 34 to a predetermined position, and for rotating it.

The elevating sheet delivery means 40 is structured by a plurality of slantingly arranged sheet delivery trays (called also bin) 41, and an elevation driving means 42 for elevating the sheet delivery trays 41 in the vertical direction.

Incidentally, the shown sheet finishing apparatus FS has 4-stage sheet delivery trays 41, however, because a sufficient space exists in portions below and above the elevating sheet delivery means 40, the sheet finishing apparatus FS whose number of bins is further increased, (for example, the sheet finishing apparatus with 10–20 bins), can also be equipped. Further, this sheet finishing apparatus FS can includes a function to assort the sheets such as a mail box, too.

Figure 3:
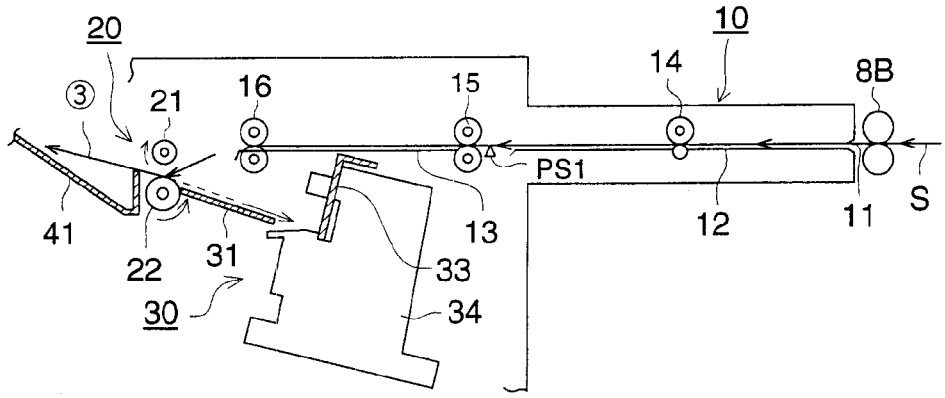
FIGS. 3(*a*) to 3(*c*) are typical views showing a conveyance and sheet delivery process of the sheet in the sheet finishing apparatus.
Figure 3:
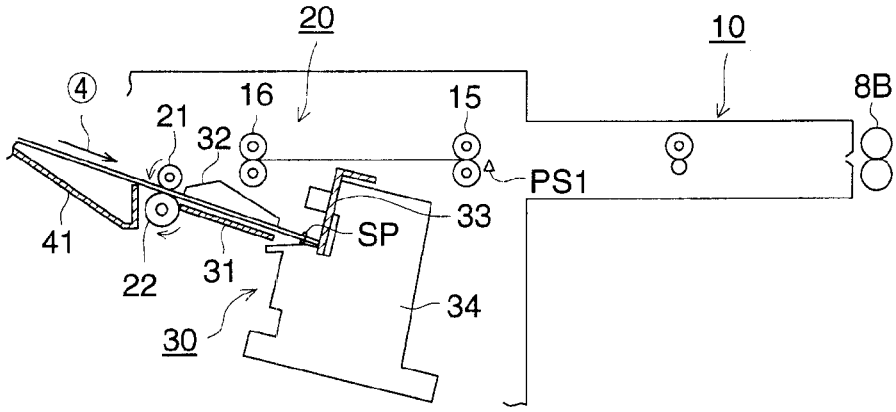
Figure 3:
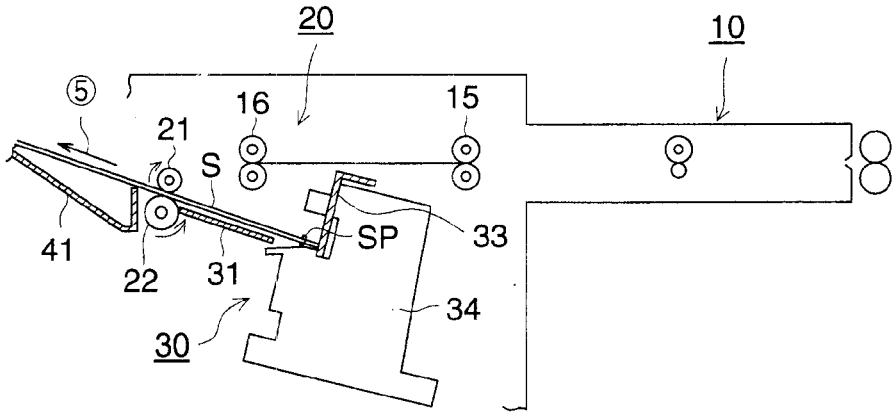

FIG. 3 is a typical view showing the conveyance and sheet delivery process of the sheet S in the sheet finishing apparatus FS.

(1) Sheet Delivery (Sheet Conveyance Path (3), Refer to FIG. 3(*a*))

The image formed sheet S delivered from the sheet delivery roller 8B of the sheet delivery section 8 of the image forming apparatus 1 is introduced in the sheet entry portion 11 of the sheet conveying means 10 of the sheet finishing apparatus FS, passes through the conveyance path in the guide plates 12, nipped by the positively rotated conveying rollers 14 and 15 and conveyed, and conveyed by nipping by the positively rotated conveying roller 16.

The leading edge portion of the sheet S is moved upward along the inclined surface of the sheet delivery tray 41 of the elevating sheet delivery means 40. When the trailing edge portion of the sheet S passes the nipping position of the conveying roller 16, the trailing edge of the sheet S is lowered by the self weight and brought into contact with the inclined surface of the intermediate stacker 31.

(2) Sending-back Sheet Delivery before Sheet Finishing (Sheet Conveyance Path (4), Refer to FIG. 3(*b*))

After the sensor PSI provided in the vicinity of the conveying roller 15 detects the passage of the trailing edge portion of the sheet S, and after measuring a predetermined time period by a timer, the sheet delivery upper roller 21 is reversely rotated and lowered, and brought into contact with the sheet. The drive of the sheet delivery lower roller 22 driven by the same driving source, is stopped by a clutch, and the lower roller 22 is driven by the sheet delivery upper roller 21. Incidentally, the sheet delivery upper roller 21 is formed of a soft foaming body such as a sponge roller, or the like, and is lightly pressure-contacted with the sheet S on the sheet delivery lower roller 22.

By this reversal rotation switching of the delivery sheet upper roller 21, the sheet S which is lightly pressure contacted by the reverselly rotated delivery sheet upper roller 21 and the sheet delivery lower roller 22 which is stopped at the nipping position, is conveyed to the slanting lower side on the intermediate stacker 31, and the trailing edge portion of the sheet S comes into contact with the stopper means 33, and the conveyance is stopped.

A pair of width alignment means 32 provided movably on the both side surfaces of the intermediate stacker 31, can move in the direction perpendicular to the sheet conveyance direction, and at the time of sheet reception during which the sheet S is conveyed on the intermediate stacker 31, the width alignment means 32 is opened broader than the sheet width, and when the sheet S is conveyed on the intermediate stacker 31 and stopped by being contacted with the stopper means 33, the width alignment means 32 taps the side edges of the width direction of the sheet S, and the width alignment of the bundle of sheets is carried out.

In the same manner, the following sheet S passes through the sheet conveyance paths (3) and (4), and successively stacked on the upper surface of the preceding sheet S, and the width is aligned each time, and the sheet S comes into contact with the stopper means 33 and is stopped.

After the trailing edge portions of all sheets S for one volume come into contact with the stopper means 33, the staple pins SP are stapled on the bundle of sheets by the staple means 34, and a booklet is formed.

(3) Sheet Delivery after the Sheet Finishing (Sheet Conveyance Path (5), Refer to FIG. 3(*c*))

When the staple processing is completed, the stopped delivery sheet upper roller 21 is switched to the positive rotation, and the bundle of sheets nipped by the delivery sheet lower roller 22 and the delivery sheet upper roller 21 which is switched to strong pressure contact by the pressure contact means 23, is conveyed toward the slanting upward portion, and housed in the delivery sheet tray 41.

Figure 4:
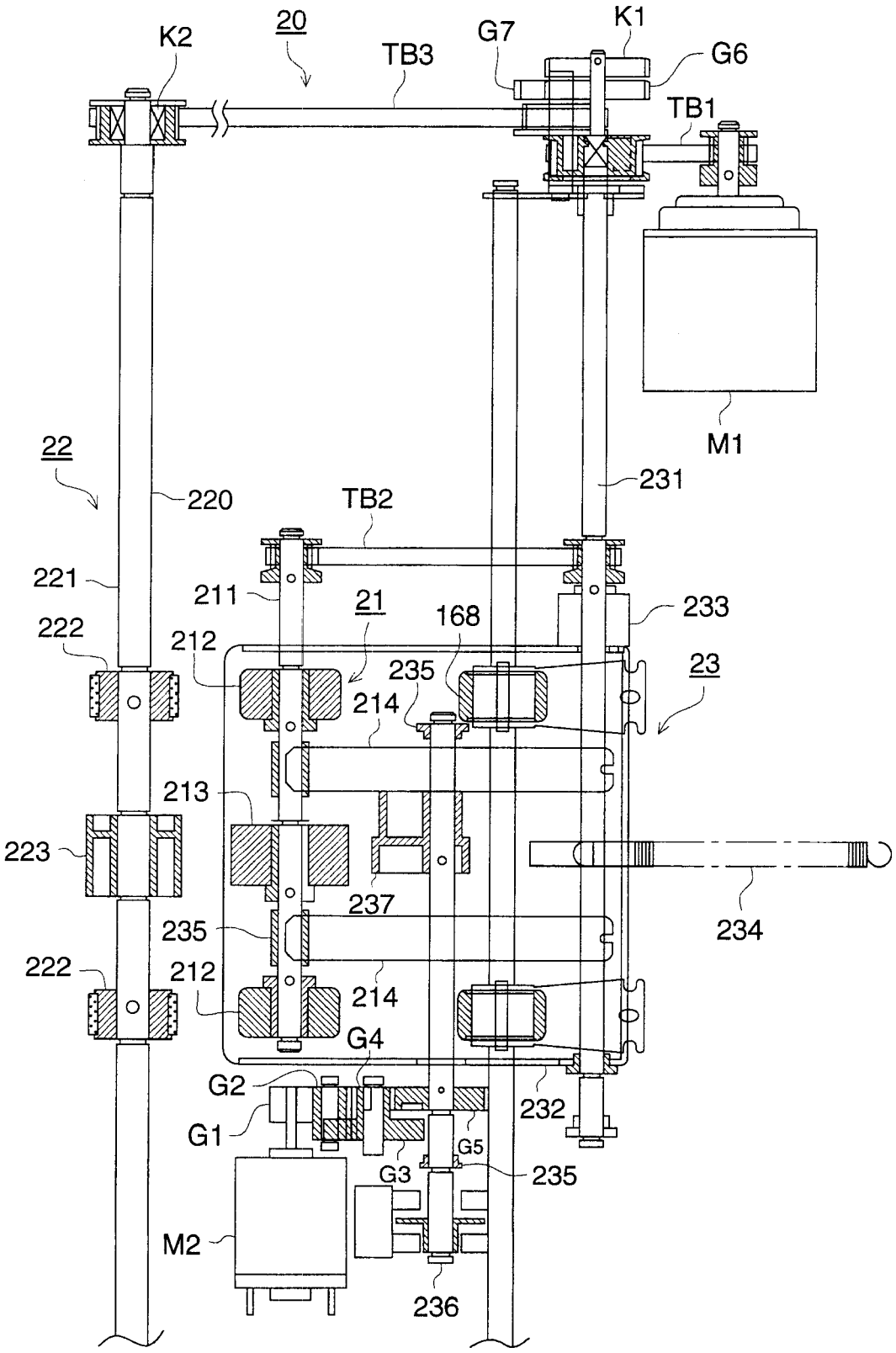
FIG. 4 is a plan view of the primary portion of the sheet delivery means.
Figure 5:
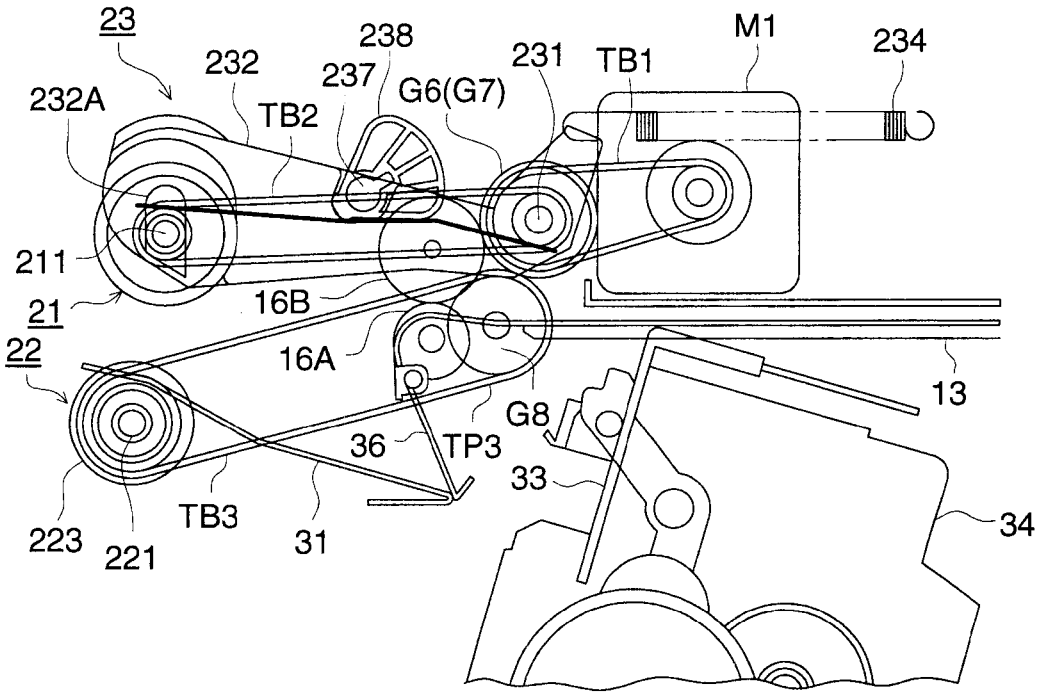
FIG. 5 is a front view of the sheet delivery means.

FIG. 4 is a plan view of the primary portion of the sheet delivery means 20, and FIG. 5 is a front view of the sheet delivery means.

A reversibly rotatable driving motor M1 oscillatingly rotates a rotation shaft 231 of the pressure contact means 23. An oscillatory member 232 fixed on the rotation shaft 231 is held so that it can be oscillated around the rotation shaft 231. Numeral 233 is a torque limiter provided on the rotation shaft 231, and numeral 234 is a pressing force adjustment spring to adjust the pressing force of the oscillatory member 232.

A groove portion 232A is provided on the top edge portion of the oscillatory member 232. The rotation shaft 211 of the sheet delivery upper roller 21 is freely engaged with the groove portion 232A and supported movably.

Two hard rollers 212 are supported on the rotation shaft 211 so that so that these rollers 212 can be driven, and the sponge roller 213 is fixed.

A timing belt TB2 is stretched between a pulley fixed on one shaft end of the rotation shaft 211 and a pulley fixed on the rotation shaft 231. By the positive and reversal rotation of the rotation shaft 231, the rotation shaft 211 is positively and reversely rotated through the timing belt TB2.

Top end portions of two pressing springs 214 fixed on the rotation shaft 231 pressure contact with the rotation shaft 211 and force the rotation shaft 211 downward.

The oscillatory member 232 is oscillated upward and downward by the drive of the torque limiter 233 by the positive and reversal rotation of the rotation shaft 211.

Above the oscillatory member 232, a rotatable rotation shaft 236 which is engaged with a bearing 235 of the pressure contact apparatus main body, is horizontally supported. The drive force is transmitted to the rotation shaft 236 from the driving motor M2 through gears G1, G2, G3, G4 and G5, and the shaft 236 is rotated.

A pressing cam 237 is fixed on the rotation shaft 236 and can integrally rotated. By the rotation of the pressing cam 237, the oscillatory member 232 is pressure contacted through the leaf spring 214.

A gear G6 fixed on the shaft end of the rotation shaft 236 is connected to a gear G7 through a mechanical clutch K1. A pulley on the same shaft as that of the gear G7 rotates the rotation shaft 221 of the sheet delivery lower roller 22 through a timing belt TB3.

Two lower rollers 222 having rubber sheath layer on the outer periphery are fixed to the rotation shaft 221. The elastic roller 212 of the sheet delivery upper roller 21 pressure contacts with and separates from the lower roller 222. The hard roller 223 arranged at the center between 2 lower rollers 222 is formed of hard resin, and is engaged with the rotation shaft 221 and can be freely rotated. The sponge roller 213 of the sheet delivery upper roller 21 pressure contacts with and separates from the hard roller 223.

In FIG. 5, a sheet presser member 36 is supported so that it can be oscillated, above the intermediate stacker 31. The top end portion of the sheet presser member 36 is forced by the self weight or spring, and lightly comes into contact with the upper surface side of the sheet stacked on the inter mediate stacker 31, and prevents the sheet advancing to the stopper means 33 from being warped, and aligns the sheets.

In the present embodiment, because the alignment means for positively conducting the arrangement of the trailing edges of the sheets on the intermediate stacker, and the sheet delivery means for delivering the bundle of sheets after finishing such as the staple processing is conducted on the intermediate stacker, onto the sheet delivery tray, are structured by the same member, the number of parts can be decreased, and the size of the apparatus can be decreased. Specifically, because there is the large difference between the pressing force to the sheets when the sheets are aligned on the intermediate stacker and the pressing force to the sheets when the bundle of several tens of sheets after finishing, is held and delivered, conventionally, the alignment means and the sheet delivery means are separately provided, however, in the present embodiment, a pressing cam 237 is provided so that the pressing force at the time of the sheet alignment and the sheet delivery can be changed, and the present embodiment is structured so that the urging force to the oscillation member 232 to support the sheet delivery upper roller 21, can be changed. Thereby, the number of parts can be reduced, and the size of the apparatus can be reduced, and the proper sheet alignment property and delivery property can be secured.

FIG. 6 is a front view showing the sheet conveyance and sheet delivery process by the sheet delivery means. The sheet conveyance and sheet delivery at the time of sheet finishing will be described below.

(1) Refer to FIG. 6(*a*)

The first sheet S1 conveyed on the sheet conveyance guide plate 13, is nipped and conveyed by a driving roller 16A driven by a conveyance driving motor, not shown, and a driven roller 16B which is driven by pressure contacting with the driving roller 16A. The trailing edge portion of the sheet S1 enters into the delivery sheet opening portion 24 under the condition that the sheet delivery upper roller 21 is separated from the sheet delivery lower roller 22.

At this time, the sheet delivery upper roller 21 and the sheet delivery lower roller 22 are positively rotated by the driving motor M1, and the oscillation member 232 is oscillated by a predetermined torque of the torque limiter 233, and is withdrawn to the upper position, and stopped.

(2) Refer to FIG. 6(*b*)

After the sensor PS1 detects the passage of the trailing edge portion of the first sheet S1, a predetermined time period is measured by the timer, and after that, the sheet delivery upper roller 21 is reversely rotated by the reversal rotation of the driving motor M1. Simultaneously, the sheet delivery lower roller 22 stops the rotation by the mechanical clutch K1, by the reversal rotation of the driving motor M1.

Further, by the reversal rotation of the driving motor M1, the torque of the torque limiter 233 provided on the rotation shaft 231, oscillates the oscillation member 232, lowers the sheet delivery upper roller 21, and applies the predetermined pressing force of about 50 g·f. The first sheet S1 is conveyed by the conveyance force by the light contact pressure of the sponge roller 213 of the driven sheet delivery upper roller 21, and is slid on the surface of the intermediate stacker 31, and conveyed toward the stopper means 33.

(3) Refer to FIG. 6(*c*)

After the trailing edge portion of the first sheet S1 comes into contact with the stopper means 33, the driving motor M1 is switched to the positive rotation, and the sheet delivery upper roller 21 and the sheet delivery lower roller 22 are positively rotated, and the oscillation member 232 is oscillated by the predetermined torque of the torque limiter 233, and is withdrawn to the upper position and stopped, and returns to the same condition as FIG. 6(*a*). In this condition, the second sheet S2, in the same manner as the first sheet S1, is nipped and conveyed by the driving roller 16A and the driven roller 16B, and enters into the delivery sheet opening portion 24.

(4) Refer to FIG. 6(*d*)

In the same manner as in the case of conveyance of the first sheet S1, after the sensor PS1 (refer to FIG. 3(*a*)) detects the passage of the trailing edge portion of the second sheet S2, a predetermined time period is measured by the timer, and after that, the sheet delivery upper roller 21 is reversely rotated by the reversal rotation of the driving motor M1, and the oscillation member 232 is oscillated to the downward portion by the torque limiter 233, and held in the same condition as FIG. 6(*b*).

The second sheet S2 is conveyed in the same manner as in the case of the conveyance of the first sheet S1, and placed on the first sheet S1, and the trailing edge portion comes into contact with the stopper member 33 and is stopped.

In the same manner as the first sheet S1 and the second sheet S2, the third and subsequent sheets repeat the operations of FIG. 6(*a*) to (*c*), and are stacked on the intermediate stacker 31. Even when the thickness of the sheets stacked on the intermediate stacker 31 is increased, the sheet delivery upper roller 21 presses the sheets with the constant force by the urging force of the torque limiter.

(5) Refer to FIG. 6(*e*)

After the staple processing on the bundle of sheets, the pressing cam 237 is rotated by the rotation of the driving motor M2, and presses a receiving surface 232B of the oscillation member 232, and strongly pressure contacts with the surface 232B. Because the sheet delivery upper roller 21 is forced by the pressing spring 214, the pressing force of the sheet delivery upper roller 21 changes corresponding to the thickness of the bundle of sheets. The sheet delivery upper roller 21 is strongly pressed by the lowered oscillation member 232 and the pressing spring 214, and strongly pressure contacts with the bundle of sheets nipped between the sheet delivery upper roller 21 and the sheet delivery lower roller 22.

Under this sheet bundle pressing condition, the sponge roller 213 of the sheet delivery upper roller 21 is pressed by the hard roller 223 of the sheet delivery lower roller 22, and deformed. Further, under this sheet pressing condition, two hard rollers 212 of the sheet delivery upper roller 21 respectively strongly pressure contacts with 2 lower rollers 222 of the sheet delivery lower roller 22, and the bundle of sheets is securely nipped.

By the positive rotation of the driving motor M1, the sheet delivery upper roller 21 is positively rotated. Simultaneously, the mechanical clutch K1 is in the engagement condition, and the sheet delivery lower roller 22 is positively rotated. The staple processed bundle of sheets is nipped by the positively rotated sheet delivery upper roller 21 and sheet delivery lower roller 22, and conveyed, and delivered onto the sheet delivery tray 41.

Incidentally, in the embodiment of the present invention, the sheet finishing apparatus connected to the copier is shown, however, the invention can be also applied for the sheet finishing apparatus connected to and used for the image forming apparatus such as the printer, facsimile device, or the like, or the light printing machine. For example, the invention can also be applied for the apparatus having the printer specification, in which the automatic document feeding apparatus DF and image reading apparatus SC, which are detachably provided to the image forming apparatus main body 1A, are removed.

In the sheet finishing apparatus and the image forming apparatus provided with the sheet finishing apparatus of the present invention, when the sheet conveyed by the conveying means is nipped between the sheet delivery upper roller and the sheet delivery lower roller which can pressure contact, can be separated, and can be positively and reversely rotated, and is conveyed to the finishing means, and the bundle of sheets can be delivered after finishing processing, the increase of the sheet conveyance performance and the sheet alignment performance can be attained, without being influenced by the curl of the sheet or static electricity.

By using both of one driving motor which is positively or reversely rotated, and the torque limiter, when the positive and reversal rotation of the sheet delivery upper roller and the sheet delivery lower roller, and the elevation driving of the sheet delivery upper roller are conducted, the mechanism becomes simple, and this is effective for the decrease of the production cost.

Next, the embodiment to attain the second object will be described. FIG. 7(*a*) is a partial plan view of the operation panel arranged on the front surface side of the image forming apparatus main body 1A. When one portion of the corner portion of the sheet S is stapled, any of the left upper or right upper portion is selected and set on the operation panel.

FIG. 7(*b*) is a plan view showing a staple pin position for staple processing onto the sheet S. In the staple processing section of the finishing means 30, the stapling on one position is conducted according to any one of the depth side one position or this side one position. The stapling on two positions is successively conducted by moving one staple means to two positions of the center.

The above one stapling position and two stapling positions are different depending on the size of the sheet S, and the staple means is moved to a predetermined position for each size of the sheet S and staple processing is conducted.

Figure 8:
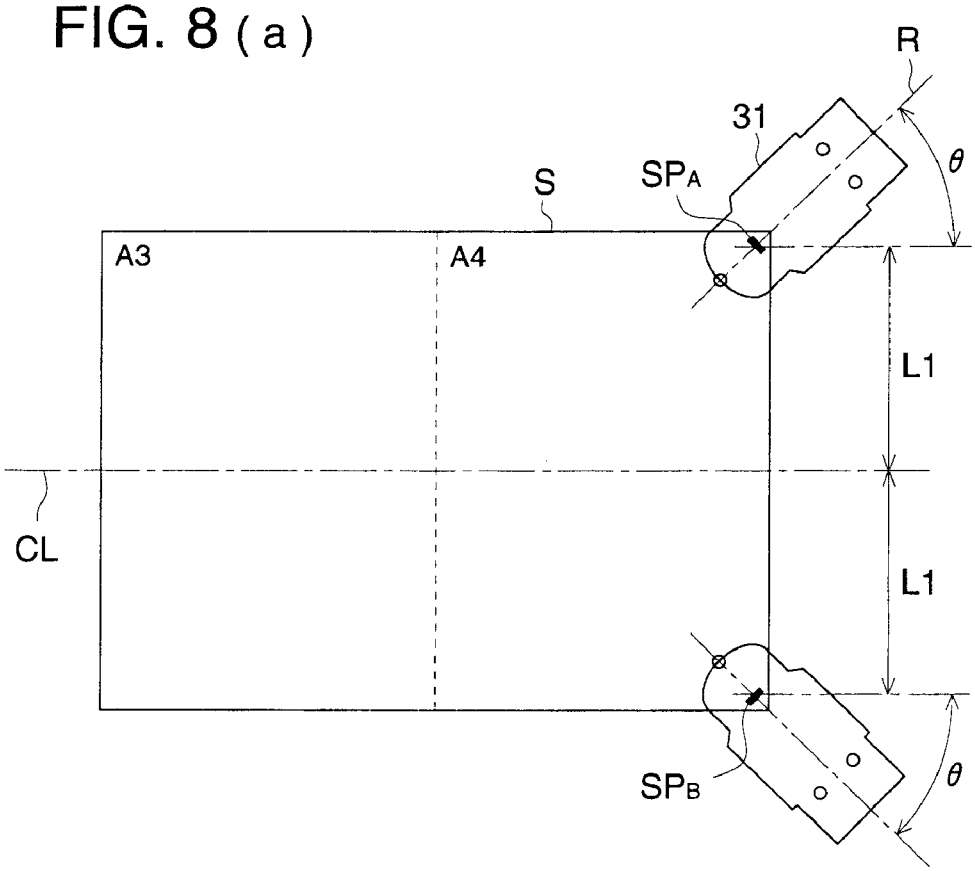
FIG. 8(*a*) and FIG. 8(*b*) are plan views showing a condition that the staple pin is slantingly stapled on one portion of the corner portion of each kind of sized sheets by one staple means.
Figure 8:
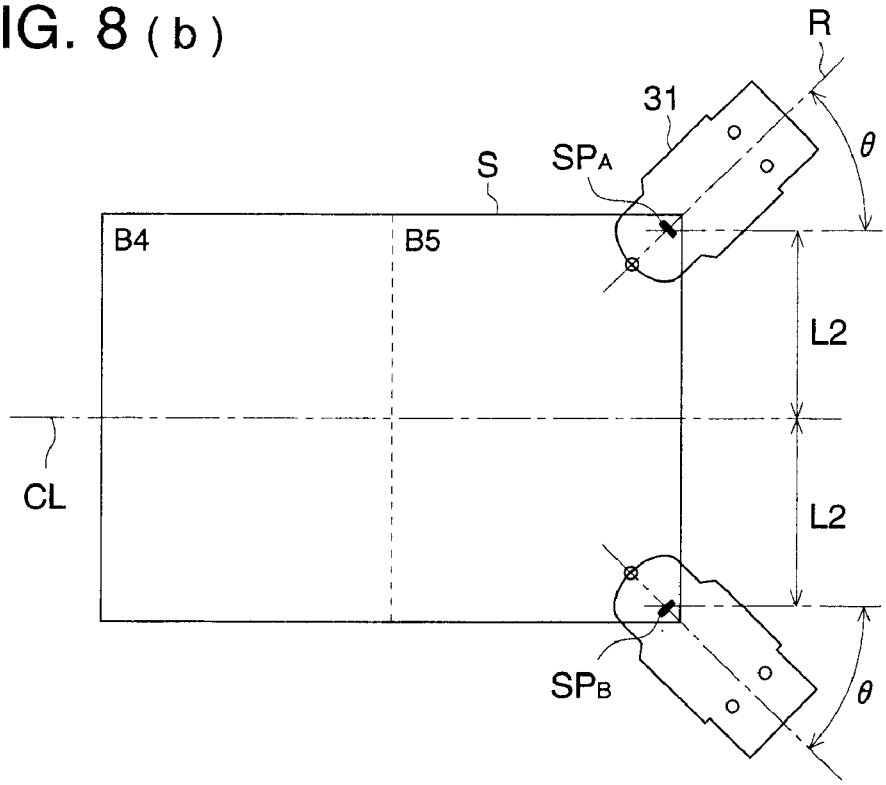

FIG. 8(*a*) is a plan view showing a condition in which one staple means 31 is linearly moved and rotationally moved to one position of the corner portion of each sheet S of the size A3 and size A4, and the staple pin $SP_A$ or staple pin $SP_B$ is slantingly stapled onto that position. The distance L1 from the center line CL of the staple pined position of the staple pin $SP_A$ (or staple pin $SP_B$) is, for example, 138.5 mm.

The staple means 31 is slantingly arranged at an initial position (home position) at the distance L1 from the center line CL in the conveyance direction of the sheet S. The inclination θ formed between the center line CL and the center line R of the staple means 31, is set to, for example, 45°.

FIG. 8(*b*) is a plan view showing a condition in which one staple means 31 is linearly moved and rotationally moved to one position of the corner portion of each sheet S of the size B4 and size B5, and the staple pin $SP_A$ or staple pin $SP_B$ is slantingly stapled onto that position. The distance L2 from the center line CL of the staple pined position of the staple pin $SP_A$ (or staple pin $SP_B$) is, for example, 118.5 mm.

FIG. 9(*a*) is a plan view showing a condition in which one staple means 31 is linearly moved to two positions which are at an equal distance L3 from the center line CL of the sheet S of each kind of size of A3 size, A4 size, B4 size, and B5 size, etc, and the staple pin $SP_A$, staple pin $SP_B$ are successively stapled onto these positions.

FIG. 9(*b*) is a plan view showing a condition in which one staple means 31 is linearly moved to two positions which are at an equal distance L2 from the center line CL of the B5-sized sheet S whose size is smaller than the above sheet S, and the staple pin $SP_A$, staple pin $SP_B$ are successively stapled onto these positions.

The staple means 31 is slantingly arranged at an initial position (home position) which is at the distance L1 from the center line CL in the conveyance direction of the sheet S, however, when the two position stapling is designated, the staple means 31 is rotated by the driving means, which will be described later, and is arranged in the position which is in parallel to the center line CL of the sheet S brought into contact with the stopper means 26, further linearly moved and stopped at a predetermined position of the distance L1 (or L2), and the staple pin $SP_A$ is stapled in parallel onto one position of the sheet S, and following that, the staple means 31 is linearly moved and stopped at a predetermined position of the distance L1 (or L2), which is at the opposite side of the center line CL, and the staple pin $SP_B$ is stapled in parallel onto one position of the sheet S.

Figure 10:
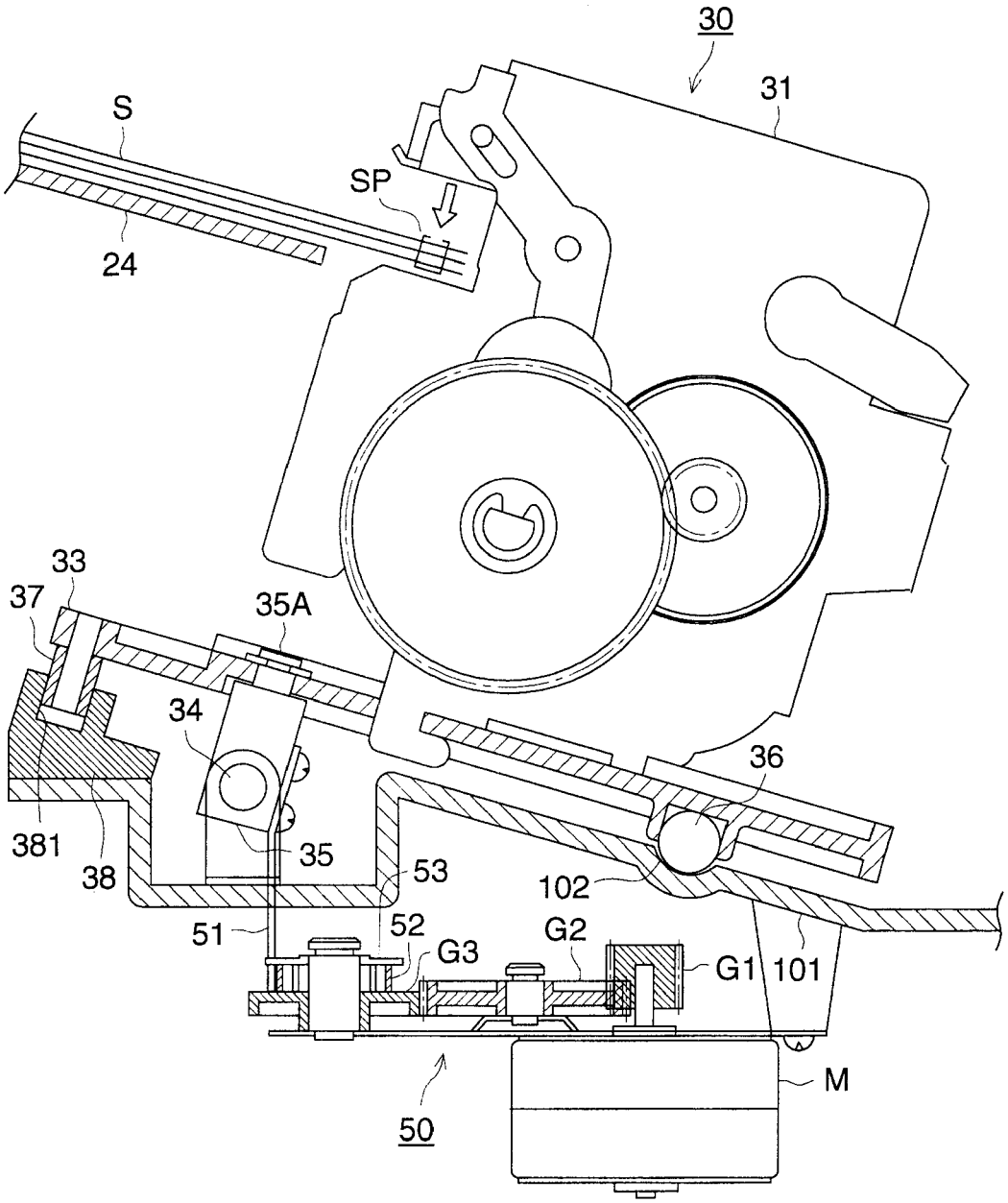
FIG. 10 is a front view of the finishing means.
Figure 11:
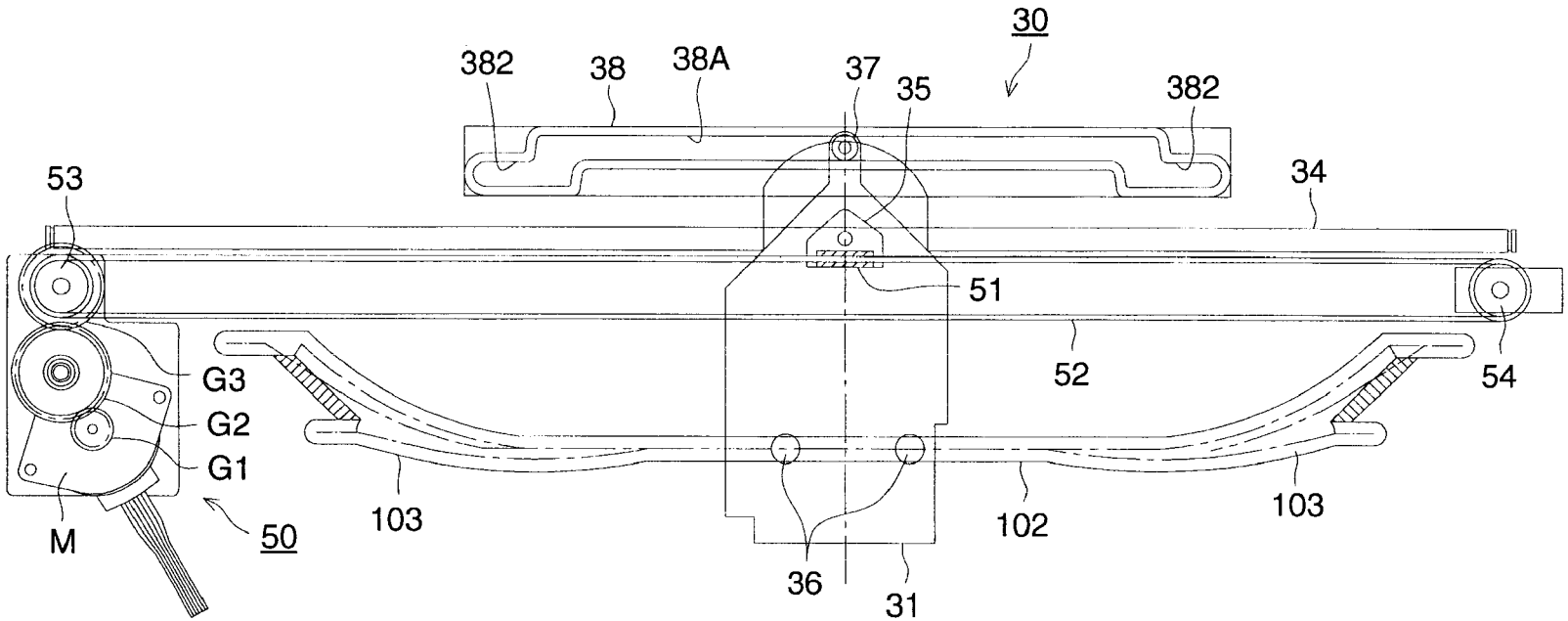
FIG. 11 is a plan view of the finishing means.

FIG. 10 is a front view of the finishing means 30, and FIG. 11 is a plan view of the finishing means 30.

A moving base 33 on which the staple means 31 is mounted, is movably supported by 3 portions of: a moving member 35 which slides on the guide shaft 34, both ends of which are fixed to and supported by the sheet finishing apparatus main body 100, and can move; and two small spheres 36 which are guided by the cam groove portion provided on the sheet finishing apparatus main body 100. The cam groove portion is formed of a front side linear cam groove portion 102 near the center, a front side curved cam groove portion 103 formed on both end portions of the front side linear cam groove portion 102, and stop portions 105 and 106 of the end of the front side curved cam groove portion 103.

The driving motor M fixed to the sheet finishing apparatus main body 100 rotates a toothed pulley 53 through a gear train of the gear G1, G2 and G3. A toothed belt 52 wound around the toothed pulley 53 and another toothed pulley 54 is rotated by the driving motor M.

A moving member 35 is fixed on the upper portion of the engagement member 51 which is fixed to one end of the toothed belt 52. The moving member 35 slides on a guide shaft 34 which is fixedly arranged on the sheet finishing apparatus main body 100, and linearly moves.

The moving base 33 is supported so that it can be rotated around a rotating shaft portion 35A of the upper portion of the moving member 35.

A roller 37 is rotatably supported on the top end portion of the moving base 33. The roller 37 rotationally comes into contact with a rear side linear cam groove portion 381 and a rear side curved cam groove portion 382, and is moved.

The moving base 33 slides on the guide shaft 34, and linearly moved by being guided by the rear side linear cam groove 381 and the front side linear cam groove 102, and is rotationally moved around the rotating shaft portion 35A of the moving member 35 by being guided by the rear side curved cam groove portion 382 and the front side curved cam groove portion 103.

Figure 12:
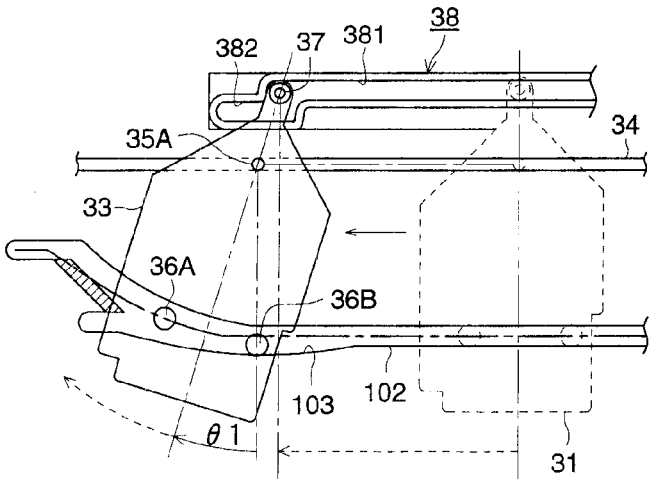
FIG. 12(*a*) to FIG. 12(*c*) are partial plan views showing an advancing process in which the staple means transfers from the linear movement to the rotational movement, and advances to the slant stapling position.
Figure 12:
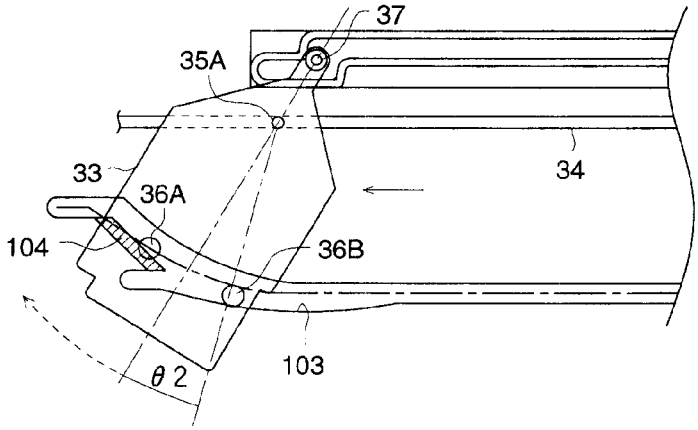
Figure 12:
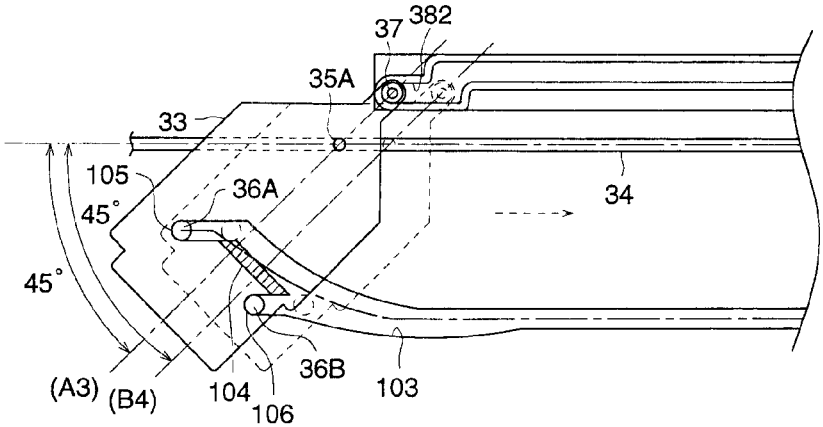

Referring to FIG. 12 and FIG. 13, the slanting staple processing by the staple means 31 will be described below.

FIG. 12 is a partial plan view showing an advancing process in which the staple means 31 transfers from the linear movement to the rotational movement and advances to the slanting staple position. FIG. 13 is a partial plan view showing a returning process in which the staple means 31 transfers from the rotational movement to the linear movement, and returns to an initial position.

(1) In FIG. 12(*a*), the driving means linearly moves the moving base 33 in the arrowed direction along the guide shaft 34, rear side linear cam groove portion 381, and front side linear cam groove portion 102.

In the interval in which the roller 37 moves from one dotted chain line portion at the center, until it comes into contact with the end portion of the rear side linear cam groove portion 381, the staple pins are stapled in parallel at the positions of L3 and L4 shown in FIG. 9.

The roller 37 further advances and comes into contact with the end portion of the rear side linear cam groove portion 381 of the cam member 38, and the advance is blocked and the roller 37 is temporarily stopped, however, the moving base 33 is further linearly moved by the driving member, and the moving base 33 is rotated around the rotating shaft portion 35A of the moving member 35 (angle θ1). In this rotation process of the moving base 33, two small spheres 36A and 36B supported by the moving base 33, pass in the front side curved cam groove portion 103.

(2) When the driving means further moves the moving base 33 in the arrowed direction, the roller 37 is out of the end portion of the rear side linear cam groove portion 381, and moves to the rear side curved cam groove portion 382, and the moving base 33 is further rotated around the rotating shaft portion 35A (angle θ2), and comes to the inclined position as shown in FIG. 12(*b*). In this rotation process of the moving base 33, one small sphere 36A supported by the moving base 33 runs on the inclined surface portion 104 provided on the front side curved cam groove portion 103, and the moving base 33 is slightly inclined.

(3) When the driving means further moves the moving base 33 in the arrowed direction, the roller 37 is moved along the rear side curved cam groove portion 382, and the moving base 33 further continues the rotation. When the roller 37 reaches the end position of the rear side curved cam groove portion 382 and is stopped, the moving base 33 rotates by a predetermined angle θ, for example, the inclination angle of 45°, and is stopped (refer to FIG. 12(*c*)).

In this rotation stop position of the moving base 33, after one small sphere 36A rotationally comes into contact with the inclined surface portion 104 provided on the front side curved cam groove portion 103, the small sphere 36A drops again on the curved cam groove portion 103, and reaches the stop portion 105 of the end position of the front side curved cam groove portion 103, and stops. Another small sphere 36B reaches the stop portion 106 of the other end position of the front side curved cam groove portion 103, and stops.

At this stop position, the small spheres 36A and 36B come into contact with the side wall portion of two end positions of the front side curved cam groove portion 103, and the rotation of the moving base 33 is blocked and held in the locked condition.

This stop position is an L1 position of the corner portion of, the sheet S with the maximum width, for example, each sheet S of A3 size and A4 size shown in FIG. 8(*a*). At this L1 position, by the staple means 31 mounted on the moving base 33 which is rotated to a predetermined inclination angle θ, the slanting staple processing is conducted.

(4) When the slanting staple processing is conducted at an L2 position of the corner portion of each sheet of B4 size and B5 size shown in FIG. 8(*b*), the moving base 33 is linearly moved in parallel by the driving means from a solid line position to a dashed line position. The parallel linear movement of the moving base 33 is conducted in such a manner that its position is regulated by the guide shaft 34 which is arranged in parallel, the linear line portion of the rear side curved cam groove portion 382, and the linear line portion of the front side curved cam groove portion 103. At this stop position, the small sphere 36A comes into contact with the side wall portion of the inclined surface portion 104, and the rotation of the moving base 33 is blocked and held in a locked condition.

In the locked condition at the dashed line position, by the staple means 31 mounted on the moving base 33 which is rotated by the predetermined inclination angle θ, the slanting staple processing is conducted at the L2 position.

Accordingly, although the stapling positions at the L2 position and the L3 position are approximated, by the difference in the movement direction of the staple means 31, the parallel staple processing and the slanting staple processing can be conducted in distinction from each other.

(5) After the slanting staple processing at the L1 position and L2 position has been completed, the moving base 33 is linearly moved in parallel by the driving means in the reversal direction of the advancing direction, while keeping the inclined position, and the roller 37 moves along the liner portion of the rear side curved groove portion 382 of the cam member 38, and comes into contact with the corner portion of the linear portion (refer to FIG. 13(*a*)).

By the roller 37 which comes into contact with the corner portion of the linear portion and whose linear movement is blocked, and the rotating shaft portion 35A which linearly moves along the guide shaft 34, the moving base 33 is rotated around the rotating shaft portion 35A (inclination angle θ3). The small spheres 36 move in the front side. curved cam groove portion 103 (refer to FIG. 13(*b*)).

(7) The moving base 33 which is rotated around the rotating shaft portion 35A is rotated when the small spheres 36 come into contact with the side wall portion of the front side curved groove portion 103 (inclination angles θ4, θ5) After the position of the moving base 33 regulated by the rotation by the inclination angle θ5, the roller 37 moves along the rear side linear cam groove portion 381, and linearly moved in parallel from the position shown by a dashed line in FIG. 13(*c*) to the position shown by a solid line in FIG. 13(*c*).

Figure 14:
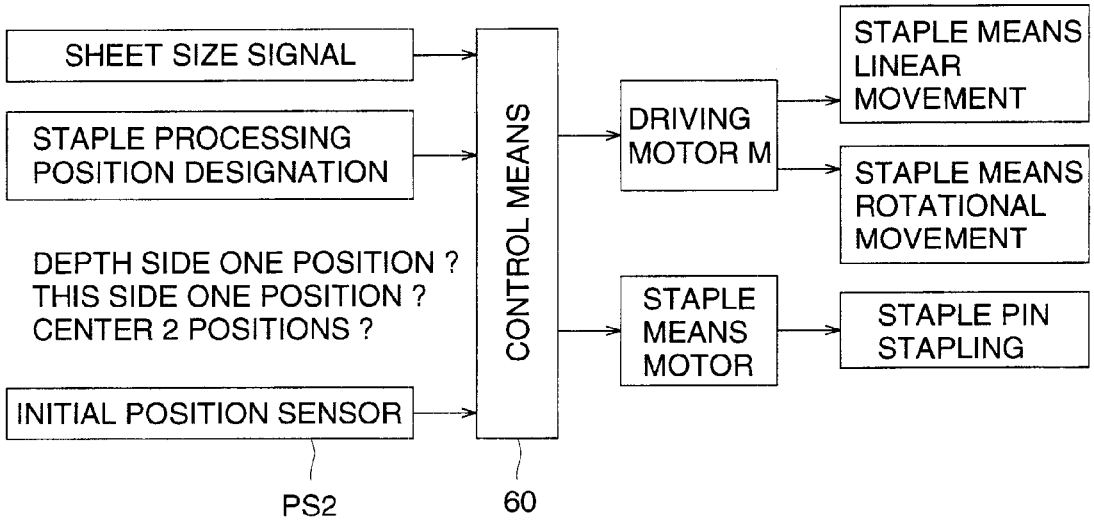
FIG. 14 is a black diagram showing the control of the staple processing.

FIG. 14 is a block diagram showing the control of the staple processing.

The sheet size signal is inputted from the image forming apparatus main body 1A into the control means 60. Further, the staple processing position onto sets of the document, such as any one of the depth side one position, this side one position, or center 2 positions, is selected and specified on the operation panel of the image forming apparatus main body 1A.

The driving motor M is structured by a stepping motor, and the initial position (home position) of the staple means 31 is adjusted by the detection signal of the initial position sensor PS2.

The control means 60 controls the driving motor M and staple means 31 motor, and drives them.

Incidentally, in the embodiment of the present invention, the sheet finishing apparatus connected to the copier is shown, however, the invention can be also applied for the sheet finishing apparatus connected to and used for the image forming apparatus such as the printer, facsimile device, or the like, or the hybrid machine having a plurality of these functions, and the light printing machine.

According to the sheet finishing apparatus of the present invention, the simplification of the component members of the staple processing of the sheet finishing apparatus can be attained. Further, the assembly adjustment operation, or maintenance operation can be easily and quickly conducted, and the reduction of the production cost can be attained.

What is claimed is:

1. A sheet finishing apparatus comprising:

a sheet passage;

a conveyor to convey a sheet along the sheet passage;

an intermediate stacker on which the sheet conveyed along the sheet passage is placed so that a bundle of sheets is formed on the intermediate stacker;

a finisher to conduct a finishing process for the bundle of sheets formed on the intermediate stacker;

a sheet delivering section to which the bundle of sheets is delivered; and a sheet delivering device to true up edges of the bundle of sheets on the intermediate stacker before the finisher conducts the finishing process and to deliver the bundle of sheets from the intermediate stacker to the sheet delivering section after the finisher has conducted the finishing process;

wherein the sheet delivering device comprises: (i) a pair of rollers capable of selectively rotating in one of a regular direction and a reverse direction, and (ii) an actuator to bring the pair of rollers in contact with each other or to separate the pair of rollers; and wherein: (i) when the sheet is placed on the intermediate stacker, the pair of rollers rotate in the regular direction and the actuator separates the pair of rollers, (ii) when the edges of the bundle of sheets on the intermediate stacker are trued up, the pair of rollers rotate in the reverse direction and the actuator brings the pair of rollers substantially in contact with each other, and (iii) when the bundle of sheets is delivered from the intermediate stacker to the sheet delivering section after the finisher has conducted the finishing process, the pair of rollers rotate in the regular direction when the pair of rollers are brought substantially in contact with each other.

2. The sheet finishing apparatus of claim 1, further comprising:

a pressing member to vary a pressing force of the pair of rollers; and wherein after the finisher has conducted the finishing process, the pair of rollers rotate in the regular direction and the pressing member increases the pressing force of the pair of rollers.

3. The sheet finishing apparatus of claim 2, wherein when the edges of the bundle of sheets on the intermediate stacker are trued up, the pressing member maintains the pressing force of the pair of rollers at a predetermined constant level regardless of how many sheets are placed on the intermediate stacker.

4. The sheet finishing apparatus of claim 1, wherein the finisher comprises a stapler to staple at least at one point on the bundle of sheets, and a stapler shifting device having a driving source to linearly shift the stapler in a direction perpendicular to a sheet conveying direction and to rotate the stapler at a position close to a corner of the bundle of sheets.

5. The sheet finishing apparatus of claim 4, further comprising:

a shifting base on which the stapler is mounted, the shifting base being capable of shifting at least one of linearly and rotatably together with the stapler;

a shifting member provided on the shifting base and arranged to be shifted linearly by the stapler shifting device; and two balls to support the shifting base so as to be shiftable.

6. The sheet finishing apparatus of claim 5, further comprising:

an elongated cam groove along which the two balls are guided so that the shifting base is supported so as to be shiftable linearly or rotatably; and a cam to guide a leading section of the shifting base so as to shift linearly or rotatably.

7. The sheet finishing apparatus of claim 6, wherein the elongated cam groove comprises a line-shaped cam groove which is located at a central portion of the elongated cam groove and which is used to shift the shifting base linearly, and curved cam grooves which are located at both ends of the elongated cam groove respectively and which are used to shift the shifting base rotatably.

8. The sheet finishing apparatus of claim 7, further comprising a locking mechanism to hold the shifting base when the shifting base is stopped at one of the curved cam grooves.

9. A sheet finishing apparatus comprising:

a sheet passage;

a conveyor to convey a sheet along the sheet passage;

an intermediate stacker on which the sheet conveyed along the sheet passage is placed so that a bundle of sheets is formed on the intermediate stacker;

a finisher to conduct a finishing process for the bundle of sheets formed on the intermediate stacker;

a sheet delivering section to which the bundle of sheets is delivered; and a sheet delivering device to true up edges of the bundle of sheets on the intermediate stacker before the finisher conducts the finishing process and to deliver the bundle of sheets from the intermediate stacker to the sheet delivering section after the finisher has conducted the finishing process;

wherein the sheet delivering device comprises: (i) a pair of rollers capable of selectively rotating in one of a regular direction and a reverse direction, and (ii) an arm-shaped actuator to bring the first roller into one of a first position in contact with the second roller and a second position apart from the second roller, (iii) a driving source coupled to the pair of first and second rollers and having a driving shaft rotatable in one of a first rotation direction and a second rotation direction, and (iv) a torque limiter having an input shaft coupled to the driving shaft and an output shaft coupled to the arm-shaped actuator; and wherein when the input shaft is rotated in the first rotation direction by the driving shaft, the output shaft swings the arm-shaped actuator so as to bring the first roller to the second position apart from the second roller, and when the input shaft is rotated in the second rotation direction by the driving shaft, the output shaft swings the arm-shaped actuator so as to bring the first roller to the first position in contact with the second roller.

10. An image forming apparatus comprising:

an image forming device to form an image on a sheet; and a sheet finishing apparatus comprising:

a sheet passage;

a conveyor to convey along the sheet passage the sheet on which the image is formed;

an intermediate stacker on which the sheet conveyed along the sheet passage is placed so that a bundle of sheets are formed on the intermediate stacker;

a finisher to conduct a finishing process for the bundle of sheets formed on the intermediate stacker;

a sheet delivering section to which the bundle of sheets is delivered; and a sheet delivering device to true up edges of the bundle of sheets on the intermediate stacker before the finisher conducts the finishing process and to deliver the bundle of sheets from the intermediate stacker to the sheet delivering section after the finisher has conducted the finishing process;

wherein the sheet delivering device comprises: (i) a pair of rollers capable of selectively rotating in one of a regular direction and a reverse direction, and (ii) an actuator to bring the pair of rollers in contact with each other or to separate the pair of rollers; and wherein: (i) when the sheet is placed on the intermediate stacker, the pair of rollers rotate in the regular direction and the actuator separates the pair of rollers, (ii) when the edges of the bundle of sheets on the intermediate stacker are trued up, the pair of rollers rotate in the reverse direction and the actuator brings the pair of rollers substantially in contact with each other, and (iii) when the bundle of sheets is delivered from the intermediate stacker to the sheet delivering section after the finisher has conducted the finishing process, the pair of rollers rotate in the regular direction when the pair of rollers are brought substantially in contact with each other.

11. The image forming apparatus of claim 10, further comprising:

a pressing member to vary a pressing force of the pair of rollers; and wherein when the bundle of sheets is delivered from the intermediate stacker to the sheet delivering section after the finisher has conducted the finishing process, the pressing member increases the pressing force of the pair of rollers.

* * * * *